US008783672B2

(12) United States Patent
Guo et al.

(10) Patent No.: US 8,783,672 B2
(45) Date of Patent: Jul. 22, 2014

(54) RACK APPARATUS

(75) Inventors: Bing Guo, Shenzhen (CN); Mao-Lin Li, Shenzhen (CN); Xi-Hua Xu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 429 days.

(21) Appl. No.: 13/209,563

(22) Filed: Aug. 15, 2011

(65) Prior Publication Data

US 2012/0168998 A1 Jul. 5, 2012

(30) Foreign Application Priority Data

Dec. 29, 2010 (CN) ..... 2010 1 0611217

(51) Int. Cl.

| | |
|---|---|
| ***A47B 96/06*** | (2006.01) |
| ***A47F 5/08*** | (2006.01) |
| ***B66F 3/00*** | (2006.01) |
| ***B23Q 3/00*** | (2006.01) |
| ***B23Q 1/00*** | (2006.01) |

(52) U.S. Cl.

USPC ..... 269/46; 248/220.21; 211/113; 254/134; 269/9

(58) Field of Classification Search

CPC ..... C25D 17/08; C25D 17/06; B25H 1/00; B25H 1/0007; B25H 1/0064

USPC ..... 254/3 B, 3 C, 7 R, 8 B, 134; 269/3, 6, 45, 269/17, 9, 55, 71, 76, 289 R, 46; 248/220.21, 220.22, 222.11, 222.14, 248/222.52, 316.1; 211/113, 118, 119.004, 211/125, 59.1, 60.1

See application file for complete search history.

(56) References Cited

U.S. PATENT DOCUMENTS 4,010,942 A * 3/1977 Ward ..... 269/15
5,897,100 A * 4/1999 Napier et al. ..... 254/8 B

FOREIGN PATENT DOCUMENTS

| | | | |
|---|---|---|---|
| CN | 2670382 | Y | 1/2005 |
| CN | 201162059 | Y | 12/2008 |
| TW | 456381 | | 9/2001 |

* cited by examiner

*Primary Examiner* — Nirvana Deonauth
(74) *Attorney, Agent, or Firm* — Novak Druce Connolly Bove + Quigg LLP

(57) ABSTRACT

A rack apparatus used for retaining a workpiece having at least one threaded hole, includes a hanging frame, and at least one clamping assembly fixed on the hanging frame. Each clamping assembly includes a plurality of latching members and a plurality of connecting members detachably assembled on the latching members. Each connecting member includes a screw portion. At least one screw portion is engaged in a corresponding threaded hole of the workpiece.

14 Claims, 3 Drawing Sheets

RACK APPARATUS

BACKGROUND

1. Technical Field

The present disclosure relates to a rack apparatus, particularly to a rack apparatus used for retaining workpieces during anodizing.

2. Description of Related Art

Generally, a rack apparatus used for retaining workpieces during an anodizing process includes a plurality of latching hooks. The workpiece is fixed to the rack apparatus by the latching hooks engaged in latching grooves of the workpiece. The shielding effect of the rack apparatus at the points of contact with the workpiece causes a different ampere density and a different solution density at the points of contact, resulting in marks or other defects at the contact regions of the workpiece after anodizing, which affects the appearance of the workpiece. A reduction in the contact areas of the workpiece is required.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the rack apparatus. Moreover, in the drawings, like reference numerals designate corresponding parts throughout the several views. Wherever possible, the same reference numerals are used throughout the drawings to refer to the same or like elements of an embodiment.

DETAILED DESCRIPTION

Figure 1:
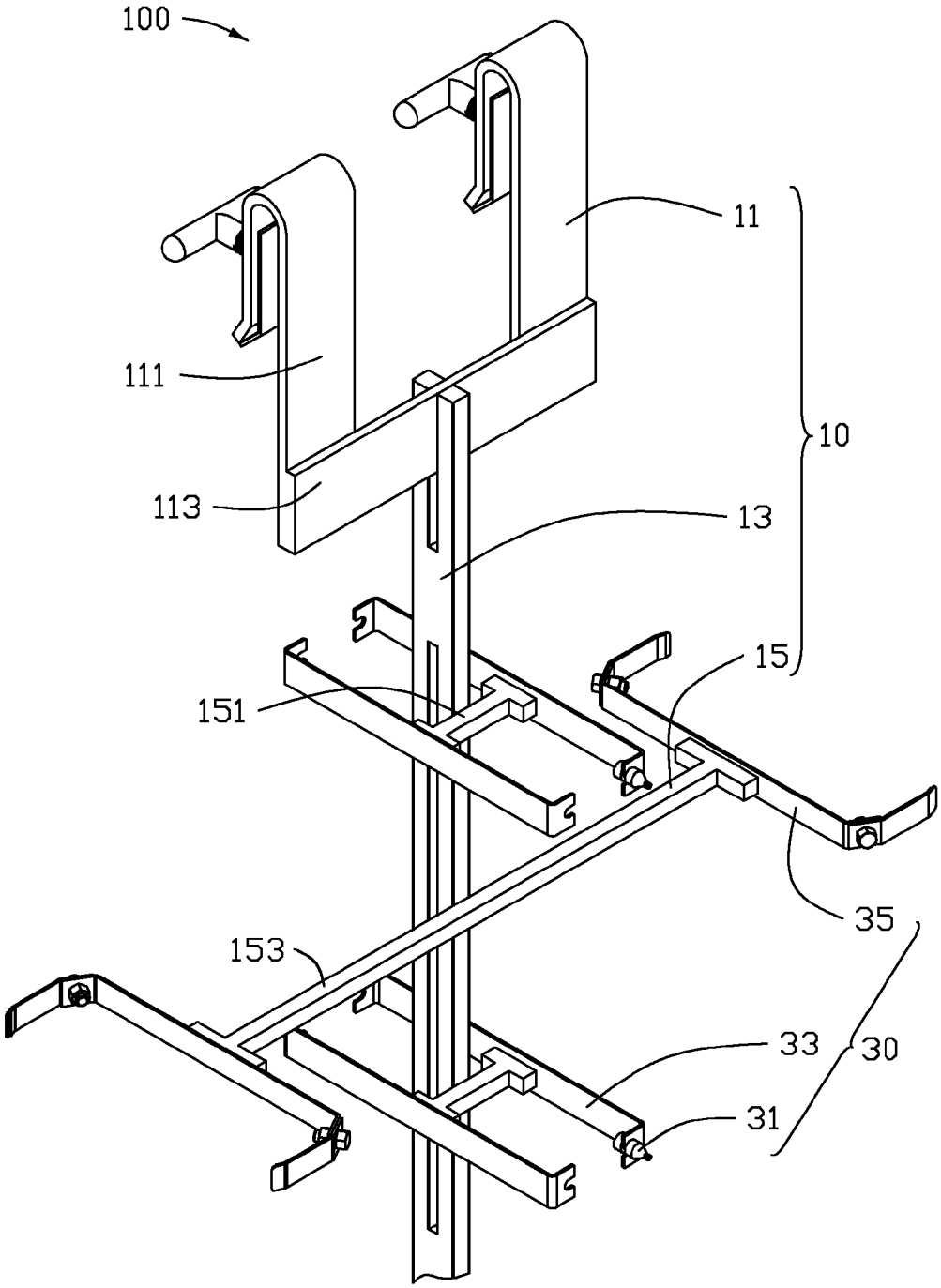
FIG. 1 is an isometric view of an embodiment of part of a rack apparatus.
Figure 2:
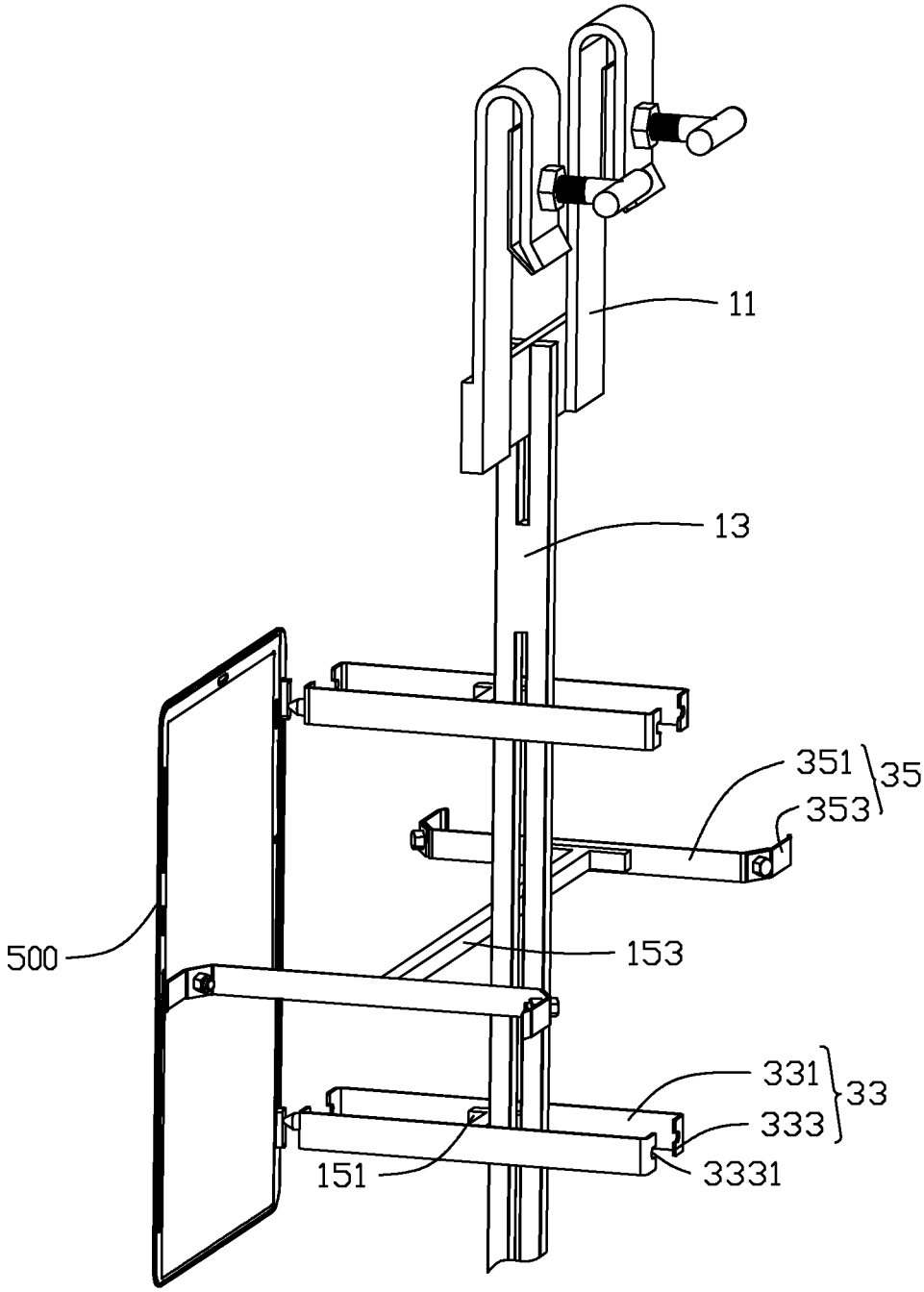
FIG. 2 is an isometric view of the rack apparatus of FIG. 1, with a workpiece installed thereon, the rack apparatus includes a plurality of connecting members.

Referring to FIG. 1 and FIG. 2, an embodiment of a rack apparatus 100 includes a hanging frame 10 and a plurality of clamping assemblies 30 fixed on the hanging frame 10. The rack apparatus 100 can be used for retaining and securing workpieces during anodizing, chemical washing, and electroplating processes. In the illustrated embodiment, the rack apparatus 100 is used for retaining workpieces 500 during an anodizing process. The workpiece 500 includes two threaded holes (not labeled) defined in close proximity to an edge of the workpiece 500 and a groove (not labeled) defined in the opposing edge of the workpiece 500.

The hanging frame 10 includes a pole member 13, a hanging member 11 fixed at an end of the a pole member 13, and a plurality of supporting members 15 fixed on the pole member 13. The supporting members 15 can be arranged on the pole member 13 in a substantially equidistant manner.

The pole member 13 can be substantially in the form of a rod or bar. The hanging member 11 can be substantially U-shaped. The hanging member 11 includes a connecting portion 113 joined to the top of the pole member 13 and two hooks 111 respectively at both ends of the connecting portion 113. The hanging frame 10 can be hung to a fixing rod (not shown) of an anodizing line with the hooks hanging on the fixing rod.

Each supporting member 15 includes two first supporting poles 151 and a second supporting pole 153 between the first supporting poles 151. The first and second supporting poles 151, 153 can be a rod or bar. In the illustrated embodiment, the second supporting pole 153 is slightly longer than the first supporting pole 151, and the difference in length between the first supporting pole 151 and the second supporting pole 153 is determined by the width of the workpiece 500 and by the respective positions of the two threaded holes and the groove. The two first supporting poles 151 and the second supporting pole 153 are attached to the pole member 13 at a same side of the pole member 13 and are substantially parallel with each other. The distance between the two first supporting poles 151 corresponds to the distance between the two threaded holes which are used for retaining the workpiece 500.

Each clamping assembly 30 corresponding to one supporting member 15 includes a plurality of connecting members 31, a plurality of latching members 33, and a plurality of resisting members 35. In the illustrated embodiment, each clamping assembly 30 includes eight connecting members 31 (parts of the connecting members 31 are not shown), four latching members 33, and two resisting members 35. The two resisting members 35 are respectively attached to either end of one second supporting pole 153. A pair of the latching members 33 is attached to either end of each of the two first supporting members 151. Each pair of connecting members 31 are detachably assembled into or onto the distal ends of each latching member 33.

Figure 3:
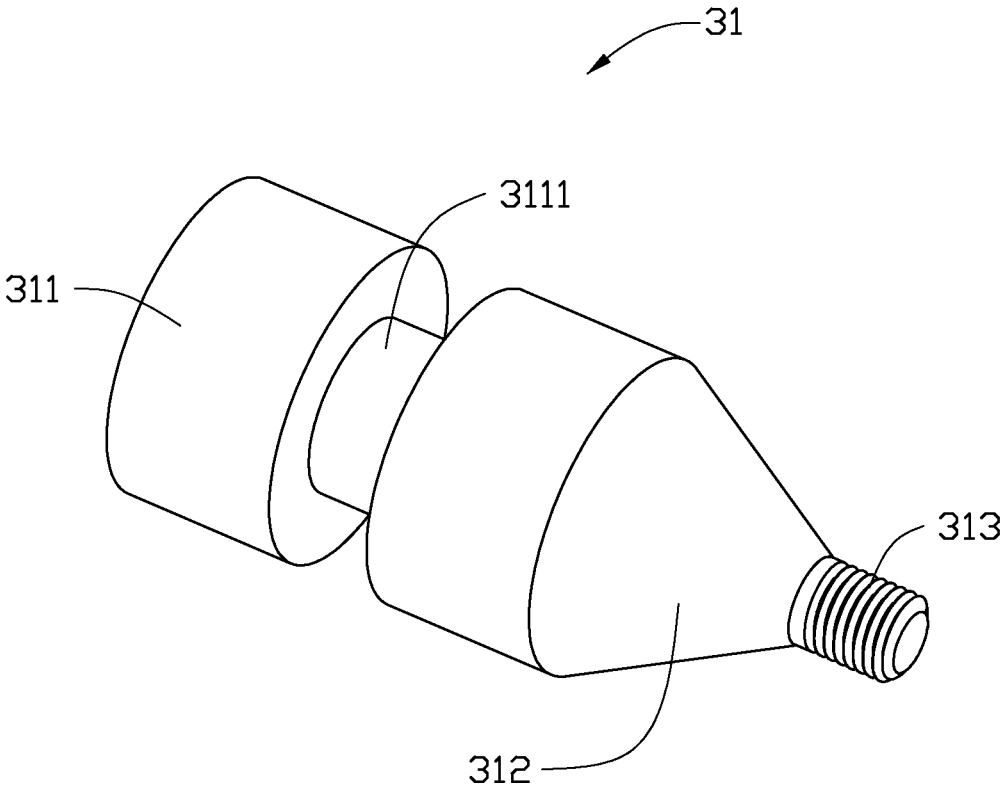
FIG. 3 is an enlarged, isometric view of a connecting member of the rack apparatus of FIG. 1.

Referring to FIG. 3, the connecting member 31 can be integrally formed. The connecting member 31 includes a cylindrical body 311, a connecting portion 312 extending out from an end of the cylindrical body 311, and a screw portion 313 extending out from an end of the connecting portion 312 away from the main body 311. The cylindrical body 311 defines a circumferential groove (latching groove 3111) at an outer side surface of the cylindrical body 311. The connecting portion 312 is conical, and the diameter of the connecting portion 312 gradually decreases from an end of the connecting member 312 adjacent to the cylindrical body 311 to the other end of the connecting member 312 adjacent to the screw portion 313. The screw portion 313 can be engaged in a corresponding threaded hole of the workpiece 500 to fix the workpiece 500.

The latching member 33 can be substantially U-shaped. The latching member 33 includes a main body 331 and two latching portions 333 extending towards each other from two opposite ends of the main body 331. The main body 331 can be formed as a thin bar or sheet of material. Each latching portion 333 defines a latching notch 3331 at a distal end of the latching portion 333 away from the main body 331. In the illustrated embodiment, the main body 331 is attached to a distal end of the first supporting pole 151 with an opening of the latching member 33 situated nearest the first supporting pole 151. In an alternative embodiment, the opening of the latching member 33 is situated furthest from the first supporting pole 151.

The resisting member 35 includes a base portion 351 and two latching hooks 353 detachably assembled on the two opposite ends of the base portion 351. The base portion 351 is attached to an end of the second supporting pole 153. The base portion 351 is made of a structurally and chemically durable metal, such as a titanium alloy which is corrosion-resistant. The latching hook 353 is made of aluminum alloy, thereby reducing the repair and maintenance costs of the latching hook 353 in an anodic oxidizing atmosphere or solution.

During the assembly of the workpiece 500 onto the rack apparatus 100, the screw portions 313 of the two connecting members 31 are respectively engaged in the two threaded holes of the workpiece 500, and the latching groove 3111 of the two connecting members 31 is fixed to each of the two latching members 33 by engagement in the latching notch 3331. A latching hook 353 of one resisting member 35 is inserted in the groove of the workpiece 500. The workpiece 500 is thus securely retained on the rack apparatus 100.

In an alternative embodiment, the groove defined in the workpiece 500 can be a threaded hole, and a connecting member 31 and a latching member 33 substituted for the resisting member 35. The workpiece 500 can be fixed to the rack apparatus 100 by three connecting members 31 and three latching members 33.

In an alternative embodiment, the latching groove 3111 of the connecting member 31 can be a diametric groove defined at a distal end of the cylindrical body 311 away from the connecting portion 312, the latching portion 333 is thereby changed into a post protruding from a distal end of the main body 331 of the latching member 33, and the post may be engaged with the latching member 33 by means of the diametric groove to secure the connecting member 31 in place.

In summary, the workpiece 500 is retained on the rack apparatus 100 by means of two connecting members 31 respectively engaged through the two threaded holes of the workpiece 500, and one latching notch 3331 of the latching member 33 engaged in the groove of the workpiece 500. In this way, the total area of physical contact between the workpiece 500 and the rack apparatus 100 is minimized, and presence of marks or blemishes on the workpiece 500 after anodic oxidation is also minimized, to improve the finished appearance of the workpiece 500.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A rack apparatus used for retaining a workpiece comprising at least one threaded hole, comprising:

a hanging frame;

at least one clamping assembly fixed to the hanging frame, the at least one clamping assembly comprising a plurality of latching members and a plurality of connecting members detachably fixed on the latching members, wherein each of the connecting members comprises a screw portion, and at least one screw portion is engaged in a corresponding threaded hole of the workpiece; each of the latching members comprises a main body and two latching portions extending towards each other from two opposite ends of the main body, each of the latching portions defining a latching notch at a distal end of the latching portion away from the main body to fix the connecting member to the latching member.

2. The rack apparatus of claim 1, wherein each of the connecting members further comprises a cylindrical body defining a latching groove, and the latching notch engages with the latching groove to fix the connecting member to the latching member.

3. The rack apparatus of claim 2, wherein each of the connecting members further comprises a connecting portion extending out from an end of the cylindrical body, and the screw portion extends out from an end of the connecting portion away from the cylindrical body.

4. The rack apparatus of claim 3, wherein the connecting portion is conical, and the diameter of the connecting portion gradually decreases from an end of the connecting member adjacent to the cylindrical body to the other end of connecting portion adjacent to the screw portion.

5. The rack apparatus of claim 3, wherein each of the connecting members further comprises a diametric groove defined at a distal end of the cylindrical body away from the connecting portion, and each of the latching members comprises a post protruding from a distal end of the main body engaged by means of the diametric groove to secure the connecting member in place.

6. The rack apparatus of claim 4, wherein each of the connecting members is integrally formed.

7. The rack apparatus of claim 1, wherein the hanging frame comprises a pole member, a hanging member jointed to the top of the pole member, and a plurality of supporting members attached at the pole member.

8. The rack apparatus of claim 7, wherein the hanging member further comprises a connecting portion and two hanging hooks respectively at either end of the connecting portion.

9. The rack apparatus of claim 7, wherein of the plurality of the supporting member members comprises two first supporting poles and a second supporting pole between the two first supporting poles.

10. The rack apparatus of claim 9, wherein the two first supporting poles and the second supporting pole are attached to the pole member at a same side of the pole member and are parallel with each other.

11. The rack apparatus of claim 9, wherein the at least one clamping assembly further comprises a resisting member comprising a base portion attached to an end of the second supporting pole and two latching hooks detachably assembled on the two opposite ends of the base portion.

12. The rack apparatus of claim 11, wherein the base portion is made of a structurally and chemically durable metal.

13. The rack apparatus of claim 12, wherein the base portion is made of titanium alloy.

14. The rack apparatus of claim 11, wherein the latching hook is made of aluminum alloy.

* * * * *